United States Patent [19]

Holland

[11] 4,062,074

[45] Dec. 13, 1977

[54] BED HAVING A MOVABLE MATTRESS SUPPORTING PLATFORM

[75] Inventor: John Anthony Holland, Belmont, Australia

[73] Assignee: Avion Australia Pty. Ltd., Osborne Park, Australia

[21] Appl. No.: 600,971

[22] Filed: Aug. 1, 1975

[30] Foreign Application Priority Data

| | | |
|---|---|---|
| Aug. 2, 1974 | Australia | 8390/74 |
| Aug. 23, 1974 | Australia | 8640/74 |
| Nov. 7, 1974 | Australia | 75146/74 |

[51] Int. Cl.[2] ..... A61G 07/10

[52] U.S. Cl. ..... 5/63; 5/66

[58] Field of Search ..... 5/61-69, 5/92

[56] References Cited

U.S. PATENT DOCUMENTS

| | | | |
|---|---|---|---|
| 3,978,372 | 11/1969 | Benoit et al. | 5/63 |
| 3,608,102 | 9/1971 | Goodman | 5/63 |
| 3,802,002 | 4/1974 | Jonas | 5/63 |
| 3,149,348 | 9/1974 | Hillenbrand | 5/63 |
| 3,835,486 | 9/1974 | Benoit et al | 5/92 |

FOREIGN PATENT DOCUMENTS

| | | | |
|---|---|---|---|
| 2,534,452 | 1/1975 | Germany | 5/63 |

OTHER PUBLICATIONS

P. 975, Sears Roebuck & Co., Fall 1975, Figs. 6 and 7.

*Primary Examiner*—Casmir A. Nunberg

[57] ABSTRACT

A bed having a movable mattress supporting platform which is mounted upon a frame having ground engaging means in the form of legs, the mounting between the platform and frame including a plurality of operating shafts rotatably mounted to the frame; at least one arm fixed to and radially extending from each operating shaft, the arm being connected to the mattress support platform by one or more connecting links so that when a turning force is applied to the operating shaft the portion of the mattress supporting platform to which the associated connecting links are attached is raised or lowered.

9 Claims, 5 Drawing Figures

BED HAVING A MOVABLE MATTRESS SUPPORTING PLATFORM

This invention relates to a bed having a movable mattress supporting platform and in particular to a bed in which the mattress supporting platform is capable of being inclined with respect to the remainder of the bed.

The invention resides in a bed having a movable mattress supporting platform wherein the platform is mounted upon a frame having ground engaging means, such as legs, the mounting between the platform and frame including a plurality of operating shafts rotatably mounted to the frame; at least one arm fixed to and radially extending from each operating shaft, the arm being connected to the mattress support platform by one or more connecting links so that when a turning force is applied to the operating shaft the portion of the mattress supporting platform to which the associated connecting links are attached is raised or lowered.

The invention will be more fully understood in the light of the following description of one specific, exemplary embodiment.

The embodiment is directed to a bed having a variable height characteristic in addition to a movable mattress support platform. The description is made with reference to the accompanying drawings in which.

Figure 1:
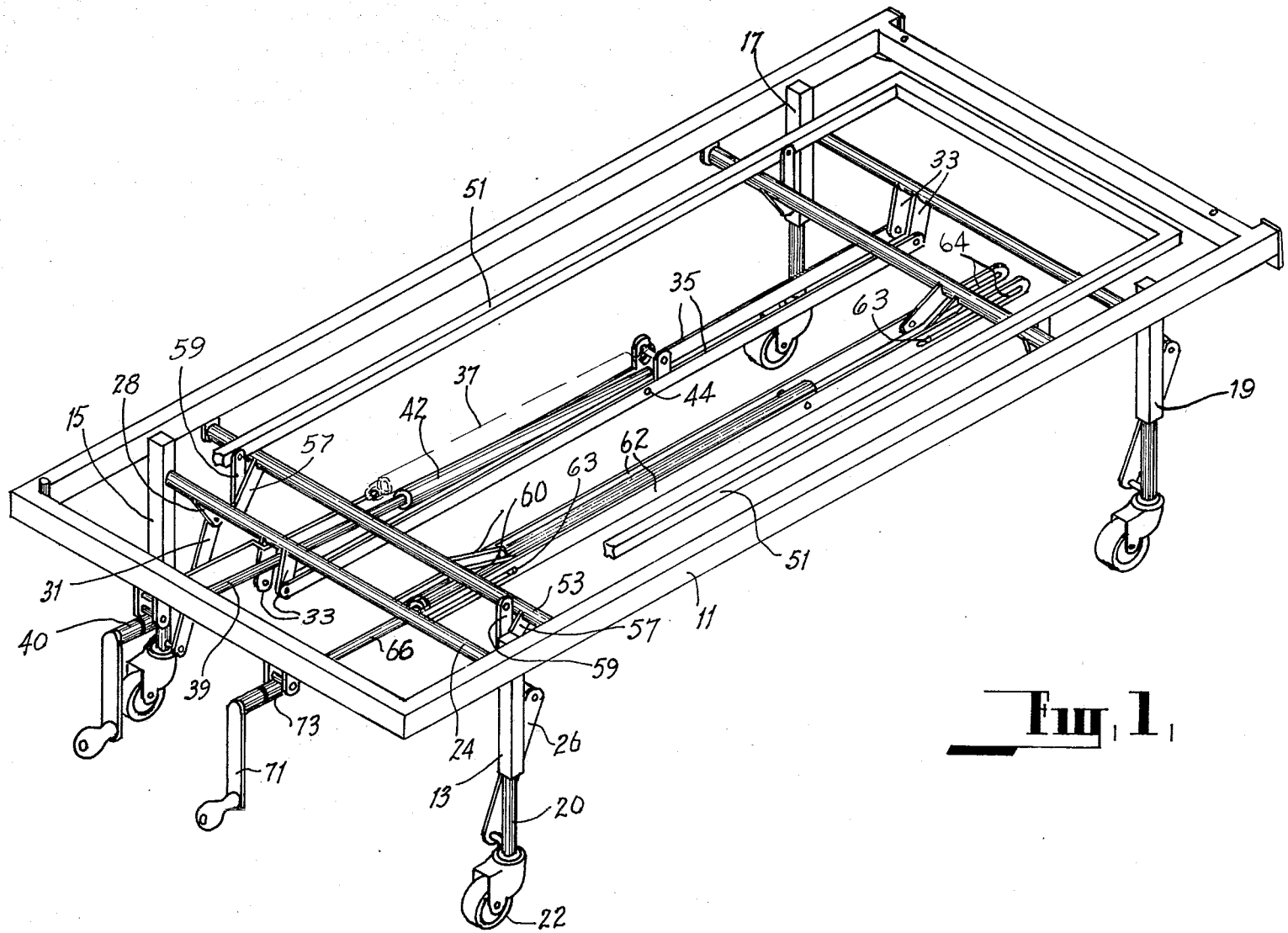
FIG. 1 is a perspective view of a portion of the embodiment incorporating a high-low adjustment shown in the raised position.

The embodiment shown comprises a rectangular frame 11 having two pairs of transversely opposed legs 13 and 15, and 17 and 19. The legs according to the embodiment are formed of square cross-section tubing. Extending portions 20 are slidably mounted in each leg to facilitate the extension of each leg. The lower end of the extending portion 20 has castors 22 mounted thereon. Two operating shafts 24 are transversely and rotatably mounted on the frame, one between each pair of legs. A knee joint 26 is provided between the operating bar 24 and each extending portion 20. The knee joint comprises an arm 28 and a connecting link 31 pivotally connected together. The upper end of arm 28 is rigidly mounted on the transverse operating shaft such that it extends radially therefrom while the lower end of the connecting link 31 is pivotally connected to the extendable portion 20 at its lower end.

A pair of lever arms 33 are rigidly attached to the operating shaft 24 and extend radially therefrom. A pair of linkage bars 35 interconnects the lever arms 33 to provide for mutual movement of the lever arms of both operating bars. A counterbalance spring 37 is mounted between the linkage bars and the mattress supporting frame 11. The drive means comprises a rod 39 having a crank handle at one end and a screw threaded portion formed at the other end. The rod 39 is rotatable supported upon the rectangular frame 11 by a bearing member 40. A screw block or ball-screw race assembly or the like 42 is mounted upon the screw threaded formation on the rod 39. The block is also rotatably supported on the linkage bars by peg members 44 which are engaged in holes 46 in the linkage bars 35.

To operate the high-low mechanism of the bed, rotation of the crank handle of the rod 39 causes the screw block 42 to move longitudinally upon the rod resulting in a corresponding movement of the link bars 35. As a result of such movement and the linkage between the link bars 35 and the lever arms 33 the operating shafts 24 are caused to rotate and through the action of the knee joint 26 the extendable portions 20 of the legs are moved to either an extended or retracted position.

Counterbalance spring 37 between the link bars 35 and the frame 11 is such that it is in its most relaxed state when the bed is at its highest position. The tension of the spring is set to counterbalance at least a portion of the weight of the occupant of the bed. The effect of such spring is to eliminate the effort required to raise the bed with an occupant lying upon it.

Figure 2:
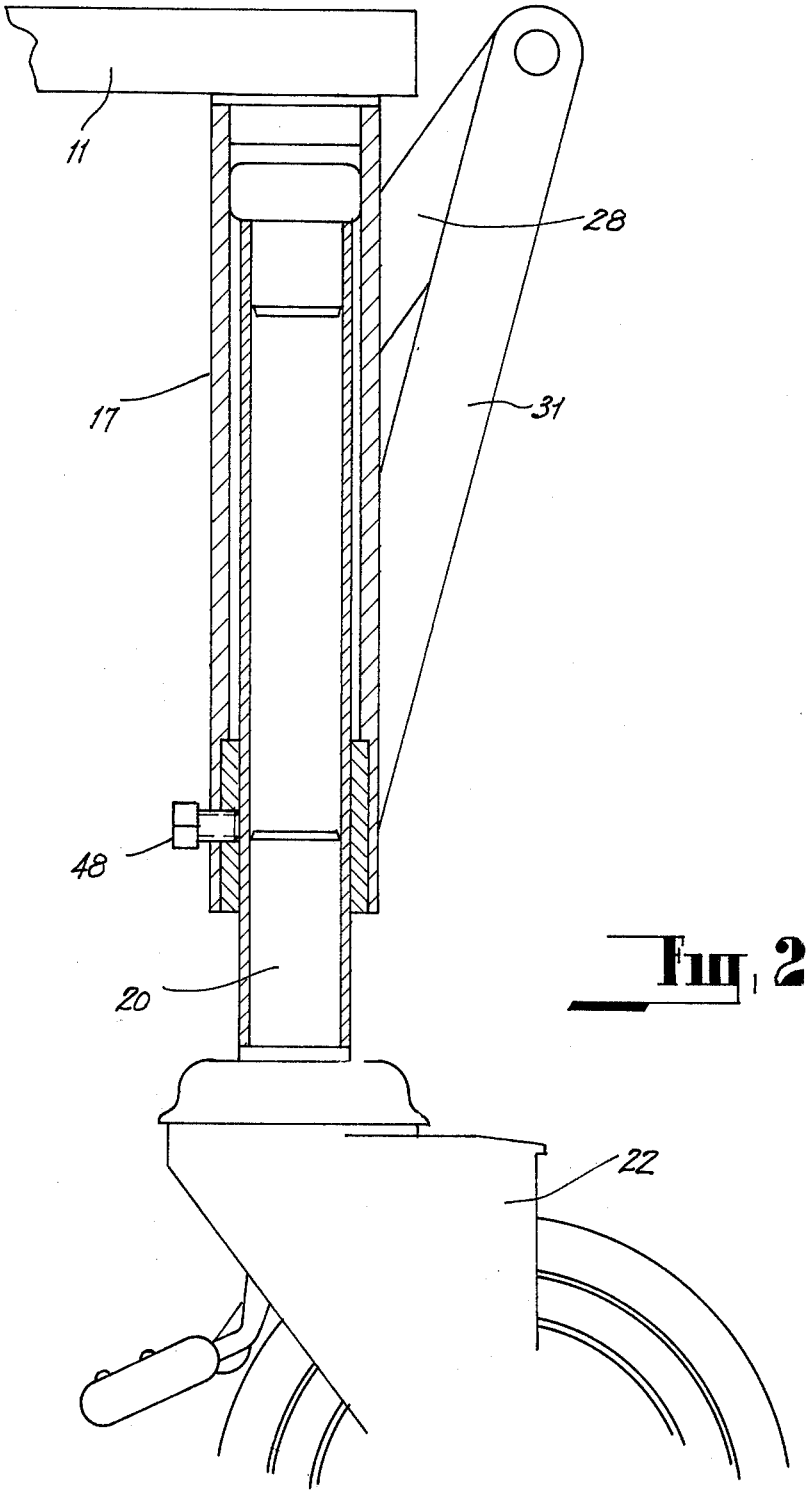
FIG. 2 is a perspective view of a leg of a different form for use on the embodiment.

According to another embodiment the legs may be modified as indicated in FIG. 2 wherein screw threaded locking studs are provided on each of the legs. The purpose of the studs is to engage the extendable portion and provide a locking means to prevent any height variation or wobble other than that produced by the force generating means.

Figure 4:
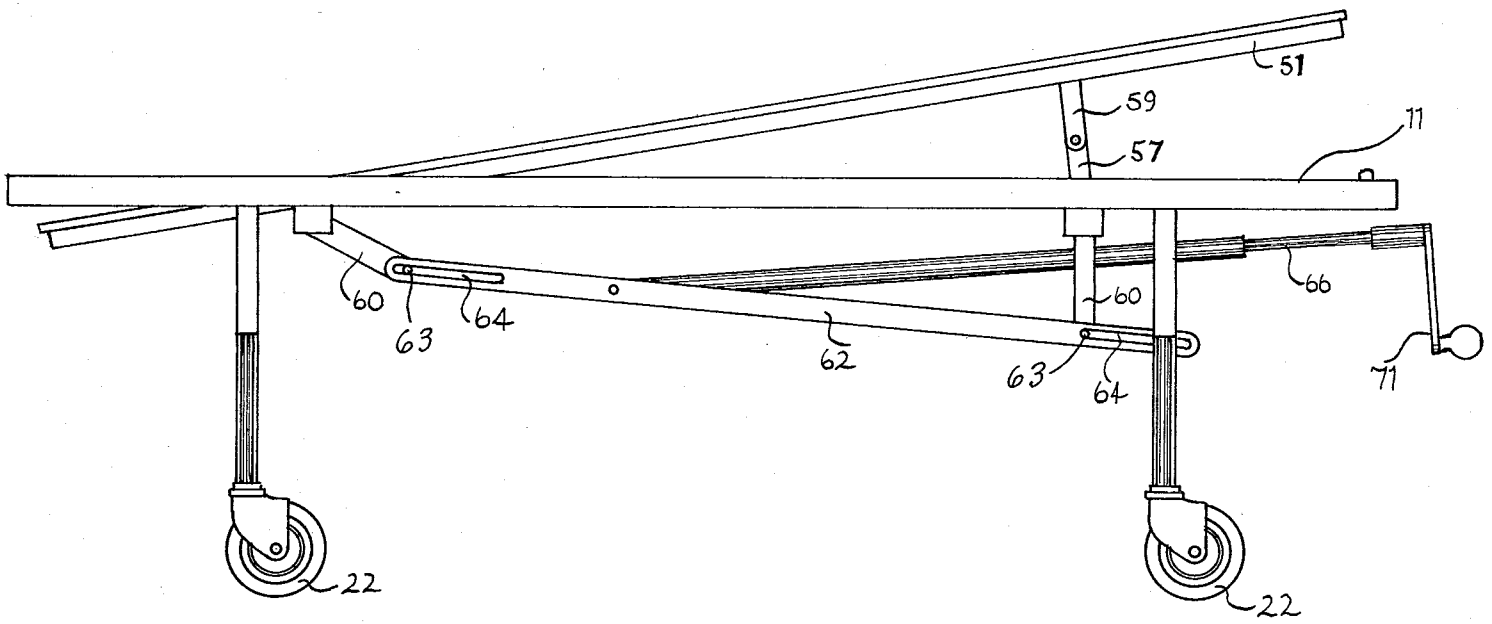
FIG. 4 is a perspective view of the portion of the embodiment illustrating the movable mattress supporting platform in the inclined position.
Figure 5:
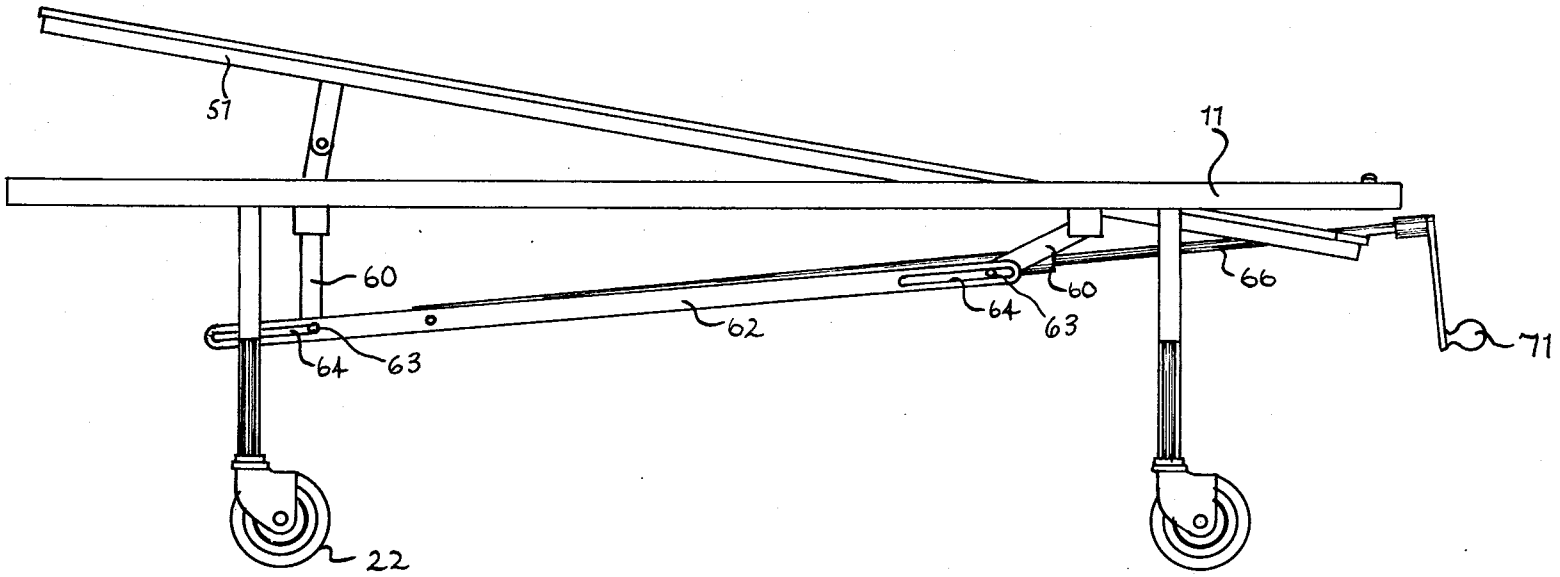
FIG. 5 is a perspective view of the bed shown in FIG. 4 shown as having the opposite inclination.

The mechanism shown in FIGS. 4 and 5 is directed to the moving of the mattress supporting platform 51 from the horizontal to an inclined position. The mechanism comprises two transverse operating shafts 53 rotatably and transversely mounted on the frame 11. Two knee joints 55 are mounted between each operating shaft 53 and mattress supporting platform 51. The knee joints comprise an arm 57 fixed to and projecting radially from the transverse operating shaft. The free end of the arm 57 has a connecting link 59 pivotally connected thereto, the other end of which is pivotally connected to the underside of the mattress supporting platform 51.

A pair of parallel operating lever arms 60 are fixed to and project radially from the operating shafts 53. The free ends of the lever arms 60 are interconnected by a pair of linkage bars 62. The mounting of the linkage bars 62 with the operating arms 60 are provided with a limited degree of longitudinal free play by means of pins 63 on arms 60 in slots 64 in bars 62. The drive means is shown separately from the frame and comprises a rod 66 having a screw threaded formation 68 at one end and a crank handle 71 at the other. The rod is rotatably mounted in the frame 11 by a bearing member 73. The screw threaded formation 68 is threadably engaged by a screw block or ball-screw race assembly or the like 75. The screw block or the like is rotatably mounted in the linkage bars 62 by pins 77.

Upon rotation of the rod 66, the screw block 75 is caused to move longitudinally upon the screw thread 68 to move the linkage bars 62 longitudinally. FIGS. 4 and 5 show the mattress supporting platform in the two extreme positions of inclination. In transferring from the position of FIG. 4 to that of FIG. 5 as the rod 66 is rotated the linkage bars 62 move left. As a result of such movement the pins 63 on the operating arms 60 on the right hand operating shaft 53 are maintained in the left hand end of the right hand set of slots 64 by the weight of the platform 51, and the mattress and occupant thereon, and as a result the right hand end of the platform 51 is lowered.

In addition as a result of such leftwise movement of the bars 62 the pins 63 on the slots 64 at the left hand end permit the bars 62 to slide on the operating arms 60 such that the left hand end of the platform 51 remains stationary. When the right hand end of the platform 51 is fully lowered, pins 63 on the operating arms 60 on both operating shafts 53 are both positioned at the adjacent inner ends of the slots 64. Further rotation of the rod 66 causes the left hand operating shafts 53 to be rotated clockwise by the engagement of the pins 63 on the left hand operating arms 60 by the right hand end of the slots 64, while the linkage bars 62 slide upon the right hand operating arms 60.

When the left hand end of the platform 51 is fully raised the pins 63 of both pairs of operating arms 60 are engaged by the right hand ends of slots 64. In a preferred form there is provision provided in the engagement of the operating arms 60 by the slots 64 such that when the platform 51 is horizontal there is some free play between the slots 64 and pins 63 on the operating arms 60. Such a feature permits self levelling of the platform and permits the operator to sense through the crank handle 71 when the platform 51 is horizontal.

To prevent the free play of the platform on the operating shafts and possible longitudinal movement of the platform when in the raised position, a stabilizing bar may be mounted between one end of the platform 51 and the operating shaft 53 at the opposite end of the frame 11, the mounting on the operating shaft 53 being rotatable to permit the shaft to rotate freely.

According to a preferred embodiment, a counterbalance spring may also be mounted between the end of each operating arm 60 and the frame 11. Each spring is mounted such that it is under maximum tension when the respective platform end is in its lowermost position. The tension of each spring is set to counterbalance the portion of the platform 51, mattress and occupant supported by the respective operating shaft 53. The purpose of the two counterbalance springs is to increase the ease with which the platform 51 may be moved from one inclined position to another.

According to a further preferred embodiment the screw threaded drive may be eliminated and each counterbalance spring may be mounted within a telescoping tube. Each telescoping tube is mounted between the frame and one or the other of the operating arms 60. A suitable frictional resistance provided on the telescopic tubing permits the tubing to be locked or released from a particular position. To alter the inclination of the bed the telescopic tubing at each end may be released from its frictional engagement and the respective end lifted or pushed down to the required height. The existence of the counterbalance spring reduces or eliminates the effort required in raising or lowering each end.

The embodiment described has several advantages over those beds currently in use. Since the mechanism of the bed for both raising and lowering the bed and for varying the inclination of the platform requires little space for their operation the mechanism can be placed directly below the mattress supporting platform. As a result a bed may be constructed which has a simple appearance which belies its operational features. Such a feature is an advantage in a hospital bed since the patient tends to be more at ease if he feels that the bed to which he has been assigned is not a machine and appears to be a normal bed. The bed according to this embodiment is capable of such appearance.

In addition, as a result of the high-low adjustment the forces on each leg are evenly distributed. However, if unequal loading does occur there is little likelihood of jamming due to the independant lifting action of each leg.

The mechanism of both the high-low adjustment and inclination adjustment may be made extremely rigid such that there is little longitudinal and/or transverse rocking which is a current problem of other geared and lever mechanisms used in beds.

The separate mattress support platform which can be inclined separately from the remainder of the bed frame provides several distinct advantages. Firstly, since the varying of the inclination does not alter the orientation of the castors there is no danger of the castors being adversely affected. In addition, such a feature permits the bed to be readily moved when the platform is at any inclination. In addition, by mounting any orthopaedic frames on the bed frame any inclination of the mattress supporting platform will not affect the frames or cause any undesirable forces or movements upon either the patient or the bed.

The use of the counterbalance spring for both the high-low adjustment and for varying the inclination enables the bed to be adjusted to the required position quite readily by one person. Such a characteristic is very important for use in hospitals where it is often very difficult to obtain several staff members to carry out the adjustments. Furthermore the adjustments may be made with little disturbance to the patient.

According to another embodiment of the invention, the screw threaded drive for the high-low adjustment may be eliminated and the tension of the spring 37 set to as nearly as possible counterbalance the weight of the patient. According to this embodiment, the legs are modified as shown in FIG. 2 as having an adjustable stud 48 providing a variable locking frictional engagement between the extendable portion 20 and the leg. By incorporation of handles around the bed frame the bed may be readily lifted or lowered by unlocking the studs 48 and applying a relatively small lifting or lowering force to the bed frame.

Figure 3:
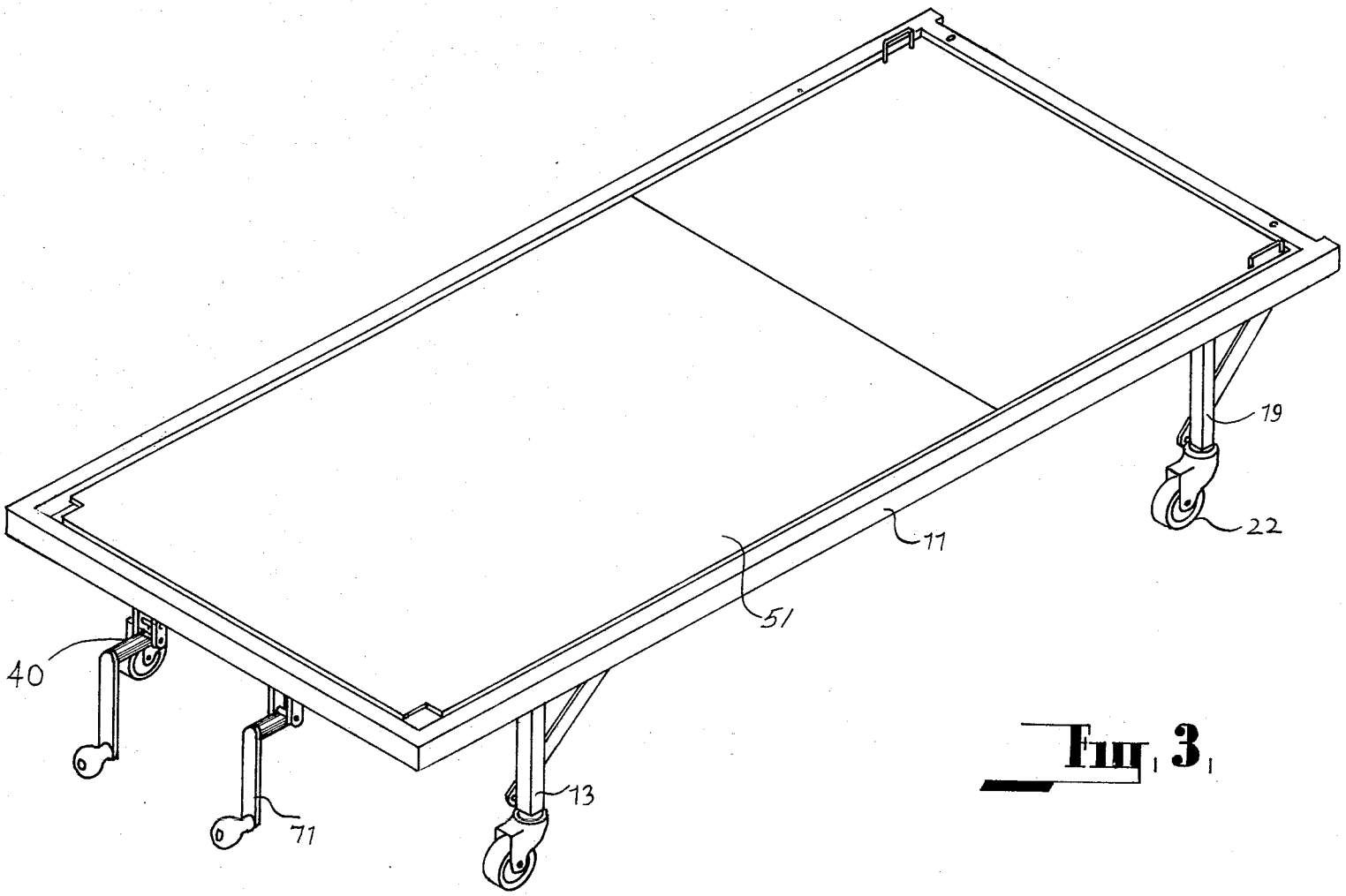
FIG. 3 is a perspective view of the portion of the embodiment of FIG. 1 shown in the lowered position.

A further variation of the first embodiment involves the isolation of the drives for each pair of legs. Such isolation may be obtained by providing two drive assemblies, one for each pair of legs. Alternatively, such isolation may be selective by means of a selective clutch in the case of a drive as shown in FIGS. 1 and 3 such that one or the other may be disengaged from operation by the screw threaded rod.

According to another embodiment, only one knee joint 26 or 55 or arm 28 or 57 may be mounted on the operating shafts 24 or 53. The linkage between the knee joint or the arm and the pair of legs or platform may take any suitable form such that the loading is evenly distributed.

It should be appreciated that the scope of this invention is not to be limited to the particular scope of the invention outlined in the exemplary embodiments.

I claim:

1. A bed comprising a mattress-supporting platform, a base for supporting said platform, means for mounting said platform on said base, said base comprising a horizontal rectangular frame extending beyond the perimeter of said platform for supporting accessories, legs mounted on said frame on the underneath thereof, the mounting means between said base and said platform including a plurality of first transverse operating shafts pivotably mounted on said frame, at least one arm radially extending from each shaft, at least on link connecting said arm to said platform so that when a turning force is applied to said first transverse operating shaft a portion of said platform to which the associated link is attached is selectively raised or lowered, and wherein said platform is intended, when horizontal, to lie closely adjacent said frame and when inclined to be inclined upwardly at one end from said frame, two pairs of said legs being mounted on said frame, the lower end of each leg being provided with an extendable portion so that the height of legs and thereby the height of said frame above the ground may be varied, a second transverse operating shaft associated with each pair of legs, each second transverse shaft being rotatably mounted at least adjacent one associated pair of legs, and means coupling said second transverse shafts and the respective pairs of associated legs for adjusting the height of the legs by rotation of said second transverse shafts to raise and lower said frame.

2. The bed as defined in claim 1, comprising a screw-threaded rod rotatably mounted in said frame and coupled to said first transverse shafts such that upon rotation of the rod, said first shafts are caused to rotate.

3. The bed as defined in claim 1, comprising means coupling said first transverse shafts such that upon a turning force being applied to one of said first transverse shafts the other first transverse shaft is caused to rotate.

4. The bed as defined in claim 1, further comprising an extension spring mounted between said frame and said second operating shafts to apply a turning force thereto, this force being sufficient to counterbalance that produced by the weight of said platform, of a mattress and at least part of the weight of the occupant of the bed.

5. The bed as defined in claim 1, comprising a second screw-threaded rod rotatably mounted in said frame and coupled to said second transverse shafts such that upon rotation of said second rod said second shafts are caused to rotate.

6. The bed as defined in claim 1, comprising means coupling said second transverse such that rotation of one causes corresponding rotation of the other.

7. The bed as defined in claim 1, further comprising an extension spring mounted between said frame and said secondary shaft to apply a turning force thereto, this force being sufficient to counterbalance that produced by the weight of said frame, and said platform, of a mattress and at least part of the weight of the occupant of the bed.

8. The bed as defined in claim 1, further comprising locking means between each of said legs and said extendable portions thereof.

9. The bed as defined in claim 1, wherein said means coupling said second transverse shafts and the respective legs comprises an arm fixed to and projecting radially from each said second transverse shaft, and connecting links connecting said arms to said extendable portions of the legs associated with said second transverse shafts so that when a turning force is applied to said second transverse shafts to effect rotation thereof the height of each of said pairs of legs associated therewith is selectively decreased or increased and said frame is raised or lowered.

* * * * *